US007388331B2

(12) United States Patent
Park

(10) Patent No.: US 7,388,331 B2
(45) Date of Patent: Jun. 17, 2008

(54) PLASMA DISPLAY APPARATUS AND MANUFACTURING METHOD THEREOF

(75) Inventor: Yu Park, Seoul (KR)

(73) Assignee: LG Electronics Inc., Seoul (KR)

( * ) Notice: Subject to any disclaimer, the term of this patent is extended or adjusted under 35 U.S.C. 154(b) by 365 days.

(21) Appl. No.: 11/123,108

(22) Filed: May 6, 2005

(65) Prior Publication Data

US 2005/0248274 A1 Nov. 10, 2005

(30) Foreign Application Priority Data

May 6, 2004 (KR) ..... 10-2004-0031605

(51) Int. Cl.
*H01J 17/49* (2006.01)

(52) U.S. Cl. ..... 313/582; 313/112

(58) Field of Classification Search ..... 313/582–587, 313/112

See application file for complete search history.

(56) References Cited

U.S. PATENT DOCUMENTS

| | | | |
|---|---|---|---|
| 6,034,474 | A | 3/2000 | Ueoka et al. |
| 6,150,754 | A | 11/2000 | Yoshikawa et al. |
| 6,235,398 | B1 | 5/2001 | Nakamura et al. |
| 6,252,703 | B1 | 6/2001 | Nakamura et al. |
| 6,255,778 | B1 | 7/2001 | Yoshikawa et al. |
| 6,275,203 | B1 | 8/2001 | Yamada |
| 6,379,803 | B1 | 4/2002 | Nakamura et al. |
| 6,429,587 | B1 | 8/2002 | Sugimachi et al. |
| 6,469,440 | B1 | 10/2002 | Saito et al. |
| 6,545,412 | B1 | 4/2003 | Jang |
| 6,569,516 | B1 | 5/2003 | Nakamura et al. |
| 6,597,525 | B2 | 7/2003 | Kubota |
| 6,638,624 | B2 | 10/2003 | Ozawa |
| 6,686,049 | B1 * | 2/2004 | Nakamura et al. ..... 428/428 |
| 6,746,629 | B2 | 6/2004 | Ozawa et al. |
| 6,836,383 | B1 | 12/2004 | Ozawa et al. |
| 6,853,125 | B1 | 2/2005 | Irie et al. |
| 6,855,369 | B2 | 2/2005 | Nakamura et al. |
| 6,856,077 | B2 | 2/2005 | Oh |

FOREIGN PATENT DOCUMENTS

| | | | |
|---|---|---|---|
| CN | 1499564 | A | 5/2004 |

* cited by examiner

*Primary Examiner*—Vip Patel
(74) *Attorney, Agent, or Firm*—Birch, Stewart, Kolasch & Birch, LLP

(57) ABSTRACT

A plasma display apparatus and a method of making the same are disclosed. The plasma display apparatus has a film filter formed by laminating multiple functional films, an electromagnetic interference shielding film of the film filter is oxidized with a conductive material, and the electromagnetic interference shielding film and grounding means are grounded. The method of making a plasma display apparatus having a film filter formed by laminating multiple functional films according to the present invention includes the steps of blackening the entire surface of the electromagnetic interference shielding film by coating with a conductive material, forming a black frame by laminating a color-dye film on the electromagnetic interference shielding film, and laminating an antireflection film on the color-dye film.

21 Claims, 4 Drawing Sheets

PLASMA DISPLAY APPARATUS AND MANUFACTURING METHOD THEREOF

This nonprovisional application claims priority under 35 U.S.C. § 119(a) on Patent Application No. 10-2004-0031605 filed in Korea on May 6, 2004, the entire contents of which are hereby incorporated by reference.

BACKGROUND OF THE INVENTION

1. Field of the Invention

The present invention relates to a plasma display apparatus and a manufacturing method thereof, and more particularly, to a plasma display apparatus having a film filter formed on a front panel, and a manufacturing method thereof.

2. Description of the Related Art

Generally, a plasma display device includes partition walls formed between front and back panels made of soda-lime glass to form a plurality of unit cells. Each unit cell generates vacuum ultraviolet rays when inert gas, such as helium-xenon (He—Xe) or helium-neon (He—Ne), is discharged by a high frequency voltage, causing fluorescent material formed between the partition walls to become luminescent, thereby realizing an image.

FIG. 1 is a view schematically showing a structure of a related art plasma display apparatus. As shown therein, the plasma display apparatus includes a case 110 having a front cabinet 111 and a back cover 112 which define the profile of the plasma display apparatus; a plasma display panel (hereinafter, PDP) 120 disposed within the case for realizing an image; a driving circuit substrate 130 having a printed circuit board for driving and controlling the PDP; a heat sink 140 connected to the driving circuit substrate 130 for radiating heat generated upon driving the plasma display apparatus; a filter 150 formed at a predetermined spacing from the front face of the PDP by adhering a film on a glass substrate (not shown); a finger spring gasket 160 and a filter supporter 170 for supporting the filter 150 and electrically connecting the same to the metal back cover 112; and a module supporter 180 for supporting the PDP including the driving circuit substrate.

The plasma display apparatus of such a structure realizes an image by applying a high voltage and a high frequency for plasma discharge, which produces the problem that this plasma display apparatus emits more electron waves onto the front face of the panel glass than a color cathode ray tube (CRT) or liquid crystal display panel (LCD) does. In addition, the plasma display apparatus emits near infrared rays (NIR) induced from the inert gas, such as Ne and Xe, and thus there is a problem that these near infrared rays cause malfunctions because they are very close in wavelength to that of a remote controller of a home electronic appliance. Moreover, there is the problem of glare caused by external light, and other various problems, such as a decrease in contrast.

Therefore, in an ordinary plasma display apparatus, a filter having a predetermined function is formed on the front face of the PDP as shown in FIG. 2.

FIG. 2 is a view showing a filter structure of the related art plasma display apparatus. As shown therein, a first functional film, i.e., an antireflection film (AR film) 152 is formed over a transparent glass substrate 151 formed at a predetermined spacing from the PDP 120. A second functional film, i.e., a color-dye film 153 for shielding near infrared rays (NIR) and adjusting colors, and a third functional film, i.e., an electromagnetic interference shielding film (EMI film) 154, are sequentially formed adjacent to the transparent glass substrate to thus form the filter 150. The transparent glass substrate 151 plays the role of protecting the PDP from an external shock as well as the role of a base for forming the filter. Such a filter of the plasma display apparatus that includes a transparent glass substrate 151 is referred to as a glass filter.

A rule is formed on the transparent glass plate 151 by blacking parts of the transparent glass plate 151 except for the effective screen area, in order to increase visual effects when viewers are watching the screen. The rule, thus blackened, is referred to as a black frame 151*a*.

The glass filter protecting against an external shock is manufactured larger in size than the front panel of the PDP, so there is no problem in forming a black frame for defining an effective screen, and no problem in the manner of grounding the electromagnetic interference shielding.

However, a film filter formed by laminating multiple functional films is problematic in that, as shown in FIG. 2, the formation of a black frame and the grounding process for the electromagnetic interference shielding are complicated.

FIG. 3 is a view showing a schematic structure of a related art plasma display apparatus having a film filter. As shown therein, the film filter 150 formed by adhering multiple functional films directly to a PDP front panel 121 by lamination or the like. The film filter 150 comprises an electromagnetic interference shielding film 154, a color-dye film 153 and an antireflection film 152.

The black frame formation of the plasma display apparatus of such a structure and the grounding process for electromagnetic interference shielding thereof will now be described.

The effective screen bounded by the black frame is made up of a copper (Cu) mesh through a given exposure process, to produce an electromagnetic interference shielding film 154. Thereafter, the electromagnetic interference shielding film 154 of the effective screen is blackened by being coated with a non-conductive material 154*a*.

The black frame 151*a* defining the effective screen is adhered to the top of the blackened electromagnetic interference shielding film 154. Thereafter, the color-dye film 153 and the antireflection film 152 are sequentially laminated thereon to form the film filter 150.

The film filter thus formed is adhered to the front panel by lamination or the like. Thereafter, in the grounding process for electromagnetic interference shielding, a non-blackened region of the electromagnetic interference shielding film is grounded using a filter support 170 to thus shield electron waves generated upon driving the plasma display apparatus.

In the plasma display apparatus manufactured using such a black frame formation process and grounding process, however, the front panel and the film filter are the same size, so it is difficult to acquire a ground contact area for electromagnetic interference shielding, thereby resulting in a production yield decrease.

Further, the black frame of the film type for defining the effective screen increases the manufacturing cost.

SUMMARY OF THE INVENTION

It is one object of the present invention to provide a plasma display apparatus and a manufacturing method, which makes it easier to form a black frame for effective screen determination, and which makes it easier to provide a grounding for electromagnetic interference shielding, by differentiating a manufacturing process of a film filter formed on a front panel of the plasma display apparatus, and which accordingly improves the production yield.

To achieve the above object, there is provided plasma display apparatus having a film filter formed by laminating multiple functional films, wherein an electromagnetic interference shielding film of the film filter is oxidized with a conductive material, and the electromagnetic interference shielding film is grounded.

The film filter for the plasma display apparatus comprises an electromagnetic interference shielding film including a first conductive layer, and a second conductive layer located on an entire surface of the first conductive layer.

A method for manufacturing a film filter for a plasma display apparatus comprises the steps of providing an electromagnetic interference shielding film of a first conductive material, and treating the electromagnetic interference shielding film to provide a second conductive material on an entire surface of the electromagnetic interference shielding film.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A preferred embodiment of the present invention will now be described in more detail with reference to the accompanying drawings.

A plasma display apparatus according to the present invention has a film filter formed by laminating multiple functional films, wherein an electromagnetic interference shielding film of the film filter is oxidized with a conductive material, and the electromagnetic interference shielding film is grounded through grounding means.

An effective screen of the electromagnetic interference shielding film is made of mesh type copper. A color-dye film having a transmissivity of 40% to 55% is laminated on the top part of the electromagnetic interference shielding film. The color-dye film is smaller in width than the electromagnetic interference shielding film. The conductive material includes at least one of the group consisting of copper oxide (CuO) with nickel (Ni) and copper dioxide ($CuO_2$) with nickel (Ni). Other suitable conductive materials may include a CuO group, a NiO group, a CrO group, a FeO group and a CoO group.

A method of making a plasma display apparatus having a film filter formed by laminating multiple functional films according to the present invention includes the step of blackening the entire surface of the electromagnetic interference shielding film by coating with a conductive material. The conductive material preferably includes nickel. In addition, a black frame is formed by laminating a color-dye film on the electromagnetic interference shielding film, and an antireflection film is laminated on the color-dye film. The top surface of the electromagnetic interference shielding film coated with the conductive material is grounded by grounding means.

Figure 1:
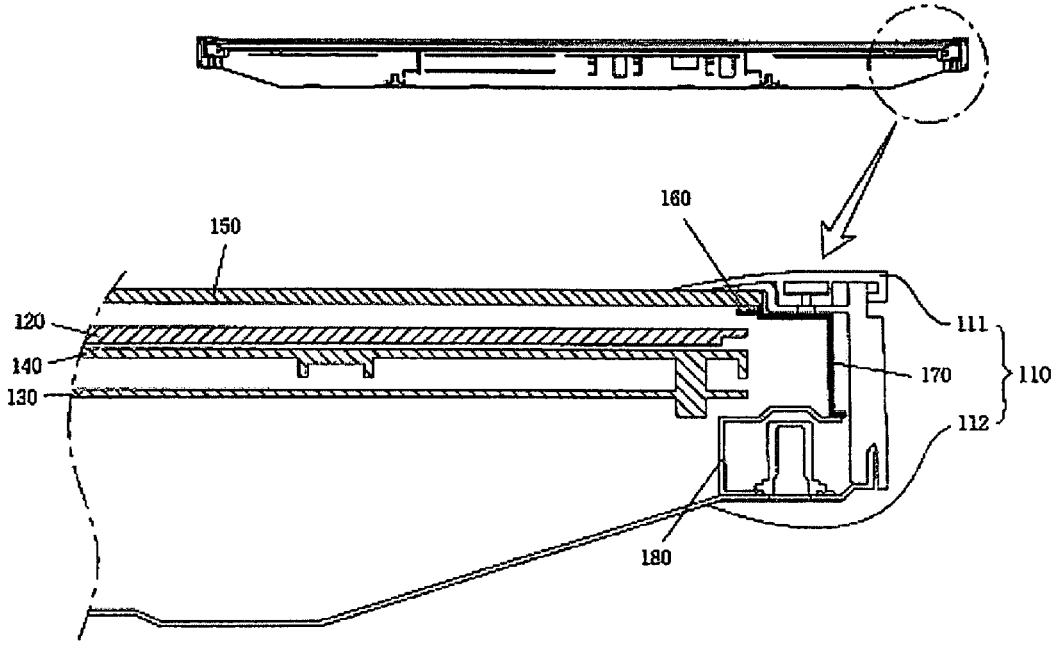
RELATED ART Fig. 1
FIG. 1 is a view schematically showing a structure of a related art plasma display apparatus.
Figure 2:
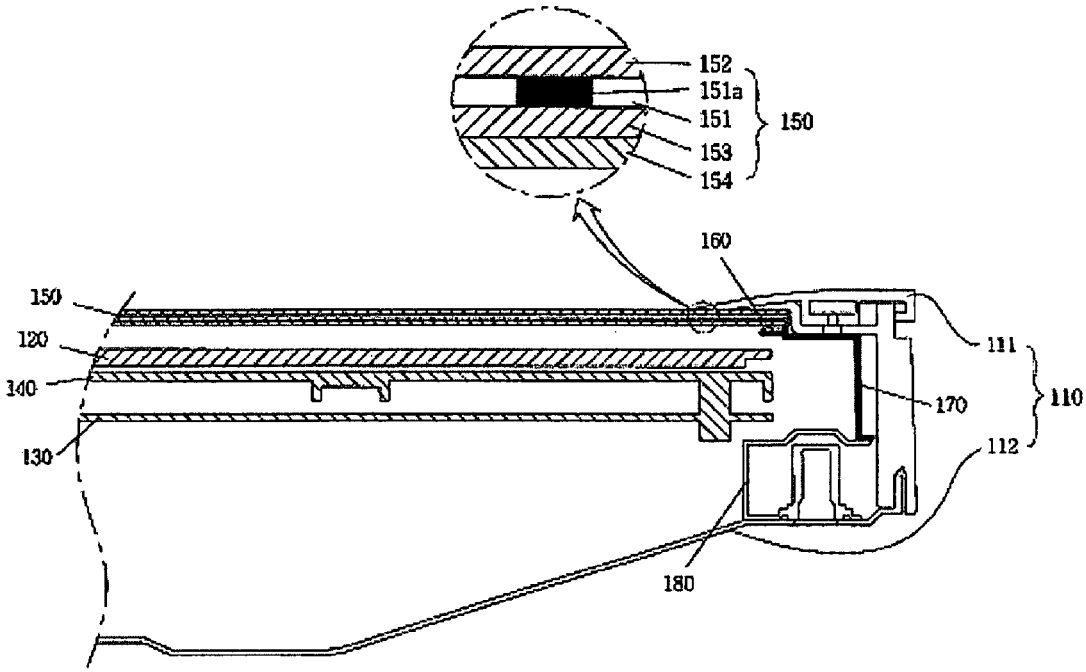
RELATED ART Fig. 2
FIG. 2 is a schematic view showing a filter structure of the related art plasma display apparatus.
Figure 3:
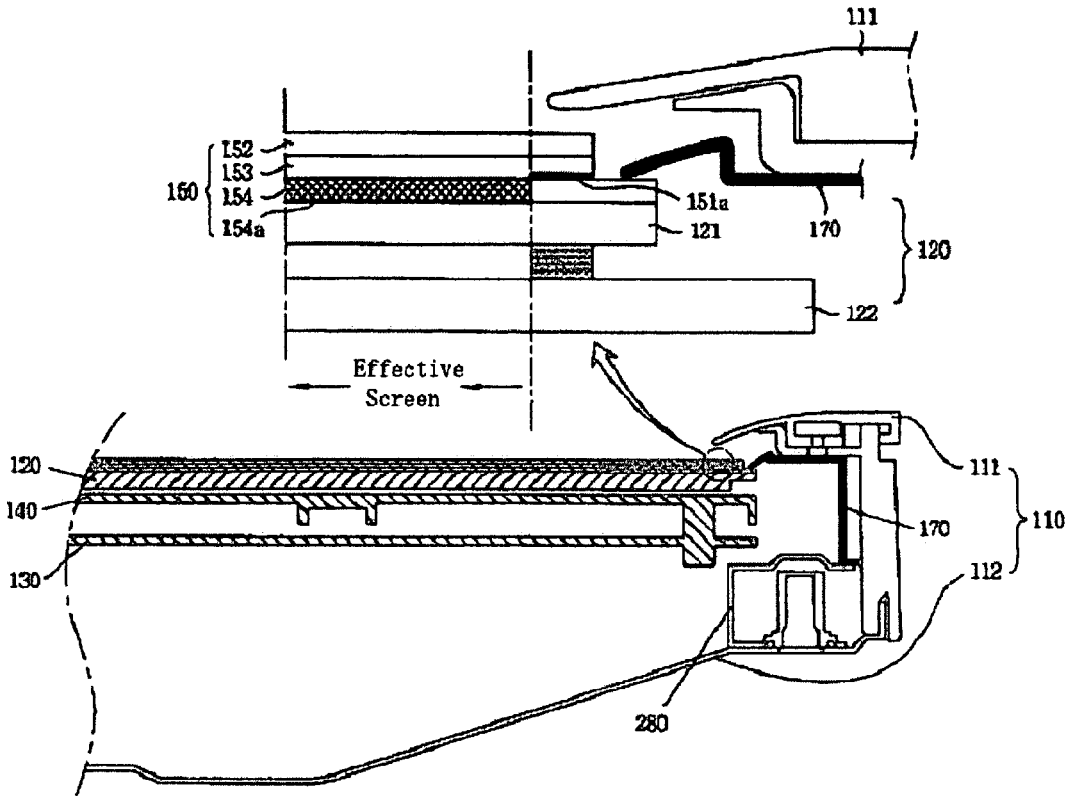
RELATED ART Fig. 3
FIG. 3 is a view showing a schematic structure of a related art plasma display apparatus having a film filter.
Figure 4:
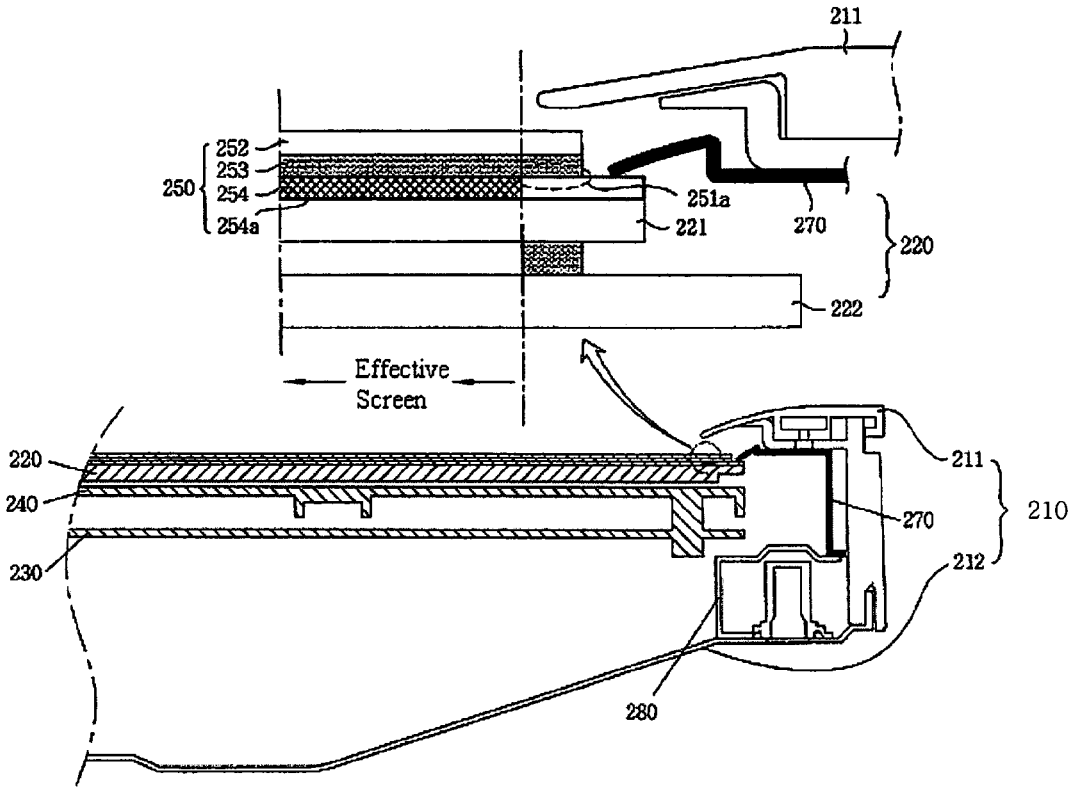
FIG. 4 is a view schematically showing a structure of a plasma display apparatus according to the present invention.

FIG. 4 is a view schematically showing a structure of a plasma display apparatus according to the present invention. As shown therein, the plasma display apparatus of the present invention includes a case 210 having a front cabinet 211 and a back cover 212 for defining the profile of the plasma display apparatus; a plasma display panel (hereinafter, PDP) 220 disposed within the case and for realizing an image by exciting fluorescent material by vacuum ultraviolet rays from gas discharge, the PDP including a front panel and a back panel coupled together; a driving circuit substrate 230 having a printed circuit board for driving and controlling the PDP; a heat sink 240 connected to the driving circuit substrate 230 for radiating heat generated upon driving the plasma display apparatus; a filter 250 formed by laminating functional films having predetermined functions on the front panel of the PDP; a filter supporter 270 for supporting the filter 250 and electrically connecting the filter 250 to the metal back cover 212; and a module supporter 280 for supporting the PDP including the driving circuit substrate.

The film filter 250 comprises an electromagnetic interference shielding film 254, a color-dye film 253, and an antireflection film 252.

The electromagnetic interference shielding film 254 is made of copper (Cu) and is divided into an effective screen and a non-effective screen according to location. That is, the effective screen is made of mesh type copper so as to have a predetermined transmissivity, while the non-effective screen is formed of randomly dispersed copper particles so as to have a lower transmissivity than the effective screen (picture area) The entire part of such an electromagnetic interference shielding film 254 is oxidized with a conductive material 254*a* of the gray family. For example, the electromagnetic interference shielding film 254 may be blackened by being coated with the conductive material 254*a* of the gray family. The conductive material 254*a* to be used includes at least one of the group consisting of copper oxide (CuO) with nickel (Ni) and copper dioxide ($CuO_2$) with nickel (Ni).

The conductive material 254*a* of the gray family makes it easier to manufacture a black frame for defining the effective screen of the PDP to be described later. Namely, when the color-dye film 253 having a predetermined transmissivity is laminated on the top surface of the electromagnetic interference shielding film 254, a black frame 251*a* is formed. The procedure of forming a black frame 251*a* will be explained in the method of making the plasma display apparatus.

The color-dye film 253 is the same in width as the antireflection film 252 but smaller than the electromagnetic interference shielding film 254 in order to acquire a sufficient ground contact area for electromagnetic interference shielding.

The method of making a plasma display apparatus having the aforementioned structure will now be described.

A front panel 221 and a back panel 222 made of soda-lime glass are prepared. A film filter 250 is formed by laminating multiple functional films having predetermined functions to be adhered to the PDP front panel 221. The procedure of making the film filter will now be described.

An electromagnetic interference shielding film 254 is formed by applying copper (Cu) to a base film (PET) in a film shape by electronic beam deposition, sputtering, wet coating and so on. At this time, an effective screen is formed in a mesh configuration through a given exposure process in order to increase the transmissivity of the effective screen of the electromagnetic interference shielding film 254. Thereafter, the entire electromagnetic interference shielding film is blackened by being coated with a conductive material of the gray family. The conductive material to be used preferably includes at least one of the group consisting of copper oxide (CuO) with nickel (Ni) and copper dioxide ($CuO_2$) with nickel (Ni).

Thereafter, a color-dye film 253 and an antireflection film 252 are sequentially laminated on the electromagnetic interference shielding film 254 to form the film filter 250. The electromagnetic interference shielding film 254 is the same in size as the front panel 221, while the other functional films, i.e., the color-dye film 253 and the antireflection film 252 are smaller than the electromagnetic interference shielding film 254. This is because if the functional films are the same in size, in the grounding process for electromagnetic interference shielding, the grounding process becomes difficult.

A black frame 251*a* for determining the effective screen is formed from the color-dye film 253. That is, when the color-dye film 253 having a transmissivity of 40% to 55% is laminated, the blackened electromagnetic interference shielding film 254 and the color-dye film 253 form a black frame face 251*a* having a very low transmissivity. The effective screen of the electromagnetic interference shielding film 254 is not formed of a black face since it is made of mesh and has a high transmissivity. As a result, the black frame for determining the effective screen is formed in an outline shape on the periphery of the case of the plasma display apparatus.

The film filter 230 thus formed is adhered to the front panel 221 of the PDP using a laminating method or the like. Afterwards, the front panel 221 with the film filter 230 and the back panel 222 are home positioned and sealed.

Then, the grounding process is carried out for electromagnetic interference shielding by using grounding means such as a filter support 270, and the installation of a driving circuit substrate for driving the PDP and a heat sink is carried out in the same way as in the related art.

As described above, the plasma display apparatus formed through the process of this invention can easily solve the difficulty of acquiring a ground contact surface caused from blackening by coating a non-conductive material in the related art, thereby reducing working time depending on the manufacture process and accordingly improving the production yield. Further, the manufacturing cost can be reduced by using the film filter of the present invention, which does not require an additional process for forming a black frame.

From the foregoing, it is understood by those skilled in the art that various modifications and changes can be made to the invention within the scope of technical idea and essential characteristics. It is understood that these modifications and changes fall within the technical scope of the present invention.

The above-described examples are therefore to be considered in all respects illustrative and not restrictive or limiting, the scope of the invention being indicated by the appended claims rather than the foregoing. All changes and modifications that come within the meaning and scope of the claims and their equivalents are intended to be embraced therein.

As seen from the above description, the present invention can reduce the manufacturing process and working time of the plasma display apparatus by differentiating a film filter formation procedure, and accordingly can cut down the material cost and improve the production yield.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A film filter for a plasma display apparatus, comprising:

an electromagnetic interference shielding film including a first conductive layer, and a second conductive layer located on an entire surface of said first conductive layer, said electromagnetic interference shielding film also including an effective screen area and a non-effective screen area; and a color dye film laminated on the electromagnetic interference shielding film, said color dye film covering the effective screen area and covering a portion of the non-effective screen area, wherein the non-effective screen area has a lower transmissivity than the effective screen area such that the color dye film and the second conductive layer in the portion of the non-effective screen area form a black frame.

2. The film filter of claim 1, wherein said second conductive layer is an oxide layer.

3. The film filter of claim 1, wherein said second conductive layer is a coating layer.

4. The film filter of claim 1, wherein said second conductive layer is a blackening layer.

5. The film filter of claim 1, wherein said effective screen area is a mesh.

6. The film filter of claim 5, wherein said mesh is a copper mesh.

7. The film filter of claim 1, wherein the color-dye film has a transmissivity of 40% to 55%.

8. The film filter of claim 7, wherein said color-dye film is smaller in width than said electromagnetic interference shielding film.

9. The film filter of claim 1, wherein said second conductive layer includes at least one material selected from the group consisting of copper oxide (CuO) with nickel (Ni) and copper dioxide ($CuO_2$) with nickel (Ni).

10. A plasma display apparatus, comprising:

an electromagnetic interference shielding film including a first conductive layer, and a second conductive layer located on an entire surface of said first conductive layer, said electromagnetic interference shielding film also including an effective screen area and a non-effective screen area; and a color dye film laminated on the electromagnetic interference shielding film, said color dye film covering the effective screen area and covering a portion of the non-effective screen area, wherein the non-effective screen area has a lower transmissivity than the effective screen area such that the color dye film and the second conductive layer in the non-effective screen area form a black frame.

11. The plasma display apparatus of claim 10, further comprising:

a front glass, said electromagnetic interference shielding film being formed on said front glass.

12. The plasma display apparatus of claim 10, wherein said second conductive layer is an oxide layer.

13. The plasma display apparatus of claim 10, wherein said second conductive layer is a coating layer.

14. The plasma display apparatus of claim 10, wherein said second conductive layer is a blackening layer.

15. The plasma display apparatus of claim 10, wherein said effective screen area is a mesh.

16. The plasma display apparatus of claim 15, wherein said mesh is a copper mesh.

17. The plasma display apparatus of claim 10, further comprising a grounding member contacting said non-effective area.

18. The plasma display apparatus of claim 10, further comprising a grounding member contacting said second conductive material.

19. The plasma display apparatus of claim 10, wherein the color-dye film has a transmissivity of 40% to 55%.

20. The plasma display apparatus of claim 19, wherein said color-dye film is smaller in width than said electromagnetic interference shielding film.

21. The plasma display apparatus of claim 10, wherein said second conductive layer includes at least one material selected from the group consisting of copper oxide (CuO) with nickel (Ni) and copper dioxide ($CuO_2$) with nickel (Ni).

* * * * *